US006829998B1

(12) United States Patent
Kickbush

(10) Patent No.: US 6,829,998 B1
(45) Date of Patent: Dec. 14, 2004

(54) RELEASABLE SKATE RETARDER FOR RAILWAY CARS

(75) Inventor: Gregory F. Kickbush, Thiensville, WI (US)

(73) Assignee: Trackside Services, Inc., Milwaukee, WI (US)

( * ) Notice: Subject to any disclaimer, the term of this patent is extended or adjusted under 35 U.S.C. 154(b) by 0 days.

(21) Appl. No.: 10/626,327

(22) Filed: Jul. 24, 2003

Related U.S. Application Data

(63) Continuation of application No. 09/949,053, filed on Sep. 7, 2001, now abandoned.
(60) Provisional application No. 60/231,264, filed on Sep. 8, 2000.

(51) Int. Cl.[7] ..... B61K 7/02
(52) U.S. Cl. ..... 104/26.2; 188/62
(58) Field of Search ..... 104/26.2, 249, 104/250, 251, 252, 253, 258, 259, 260; 188/62, 63

(56) References Cited

U.S. PATENT DOCUMENTS 5,029,675 A * 7/1991 Zhukov et al. ..... 188/62
5,388,525 A * 2/1995 Bodkin ..... 104/26.2
5,676,337 A 10/1997 Giras et al.
RE36,084 E * 2/1999 Gutknecht ..... 104/249
5,967,051 A * 10/1999 Ragsdale et al. ..... 104/60
6,152,042 A 11/2000 Barry et al.

* cited by examiner

*Primary Examiner*—S. Joseph Morano
*Assistant Examiner*—Robert J. McCarry, Jr.
(74) *Attorney, Agent, or Firm*—Reinhart Boerner Van Deuren s.c.

(57) ABSTRACT

The present invention provides a releasable skate retarder for railway cars. The retarder includes a plurality of spring packs including springs which bias shoe carrying beams toward running rails, trapping wheels of a railway car entering the retarder between the shoes and the running rails, and applying a frictional force to the railway car wheels for stopping the railway car and retaining the railway car in the retarder. The retarder is operable in a release mode in which an operating mechanism moves the shoe beams to a release position in which the spring force is released, allowing the railway car to move freely through the retarder. The retarder is operable in a service mode in which the operating mechanism moves the shoe beams outwardly, allowing the insertion of shims which cause the shoes to be repositioned closer to the running rails to compensate for shoe wear. In one embodiment, the operating mechanism includes a plurality of rams and a common operating member which couples the rams to the spring packs, for drawing the shoe beams inwardly when operating in the release mode and for pushing the spring packs outwardly when operating in the service mode.

17 Claims, 5 Drawing Sheets

RELEASABLE SKATE RETARDER FOR RAILWAY CARS

CROSS REFERENCE TO RELATED APPLICATION

This application is a continuation of application Ser. No. 09/949,053, filed on Sep. 7, 2001, which claims benefit to U.S. Provisional Application 60/231,264 filed on Sep. 8, 2000.

BACKGROUND OF THE INVENTION

This invention relates to skate retarders for railway cars and, more particularly, to a releasable skate retarder including a wear adjustment mechanism.

Fixed spring-loaded retarders are commonly employed in railway classification yards. The basic function of a fixed, spring-loaded retarder is to offer a preset resistance to all railway cars that are directed into the retarder. This is provided by devices that are installed in a section of railway track to retard or arrest the rolling movement of railway cars by pressing a friction rail against the wheels of the railway cars so that the railway cars are braked by friction. One type of retarder, commonly referred to as a skate retarder, is used primarily for stopping the first railway car directed into a classification track, to allow other railway cars to be coupled to the first railway car. When several railway cars have been coupled together, the string of railway cars is pulled through the retarder.

One shortcoming of spring-loaded retarders is that the preset resistance cannot be varied without time consuming readjustment of several fastenings that hold the retarder in place. When a string of railway cars is being pulled through the retarder by a locomotive, considerable squeal noise is produced. Moreover, the high resistance to motion afforded by the retarder to all of the railway cars in the string results in considerable wear and tear on the locomotive needed to pull the string of railway cars through the retarder. Also, fuel costs are increased due to the energy required to pull a string of railway cars through the retarder. A further limitation is that the friction rails are subject to wear and must be replaced periodically as they wear. Moreover, pulling a string of railway cars through the retarder while the wheels of the railway cars are wedged between the riding rails and the friction rails can result in fatigue on the springs.

Various approaches have been proposed for reducing wear of friction rails in railway car retarders. By way of example, in U.S. Pat. No. 5,388,525, issued on Feb. 14, 1995, which was issued to W. Andrew Bodkin, there is disclosed a mechanism which allows release of the friction rails, allowing the railway cars to be moved through the retarder with reduced wear on the friction rails. The compression springs are positioned in pairs between brackets and the friction rails. A separate hydraulic release is provided for each pair of springs. The brackets are secured against dislocation from the spring force by cap screws which are received in tapped holes in the gauge plate and by clamping devices including hooked rod members and jaw members. By way of providing compensation for wear, replaceable wear plates are bolted to the friction rails. The wear plates can be replaced or reoriented when they become worn. However, this requires loosening the bolts for each bracket and adjusting the hooks to change the wear plates. This is a time consuming task considering the large number of spring pairs that employed. For example, replacement of the wear plates can take two or more hours, and the cost for such maintenance can be considerable. Moreover, during this results in considerable down time for the classification yard.

SUMMARY OF THE INVENTION

The present invention provides a releasable retarder for railway cars. The retarder includes a first and second shoe beams, which support replaceable shoes in parallel, spaced relation with first and second running rails. A plurality of spring packs includes springs which bias the shoe beams toward the running rails, trapping wheels of a railway car entering the retarder between the shoes carried by the shoe beams and the running rails, and applying a frictional force to the railway car wheels for stopping the railway car and retaining the railway car in the retarder. An operating mechanism moves the shoe beams between a home position in which the shoes are positioned to engage the railway car wheels, and a release position in which the spring force is released, allowing the railway car to move freely through the retarder. The operating mechanism includes a plurality of rams and a common operating member which couples the rams to the spring packs, for causing the springs to be compressed, drawing the shoe beams inwardly away from the running rails to the release position. In one embodiment, the common operating member is coupled to the spring packs through a plurality of lever systems.

In accordance with another aspect of the invention, the retarder provides for rapid and easy adjustment of the gap between the shoes and the running rails for compensating for wear of the shoes. In one embodiment, the rams are bidirectional devices, allowing the retarder to function also in a service mode in which the operating mechanism moves the shoe beams outwardly, allowing the insertion of shims. The presence of the shims causes the shoes to be repositioned closer to the running rails, compensating for wear on the shoes.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DETAILED DESCRIPTION OF THE PREFERRED EMBODIMENTS

Figure 1:
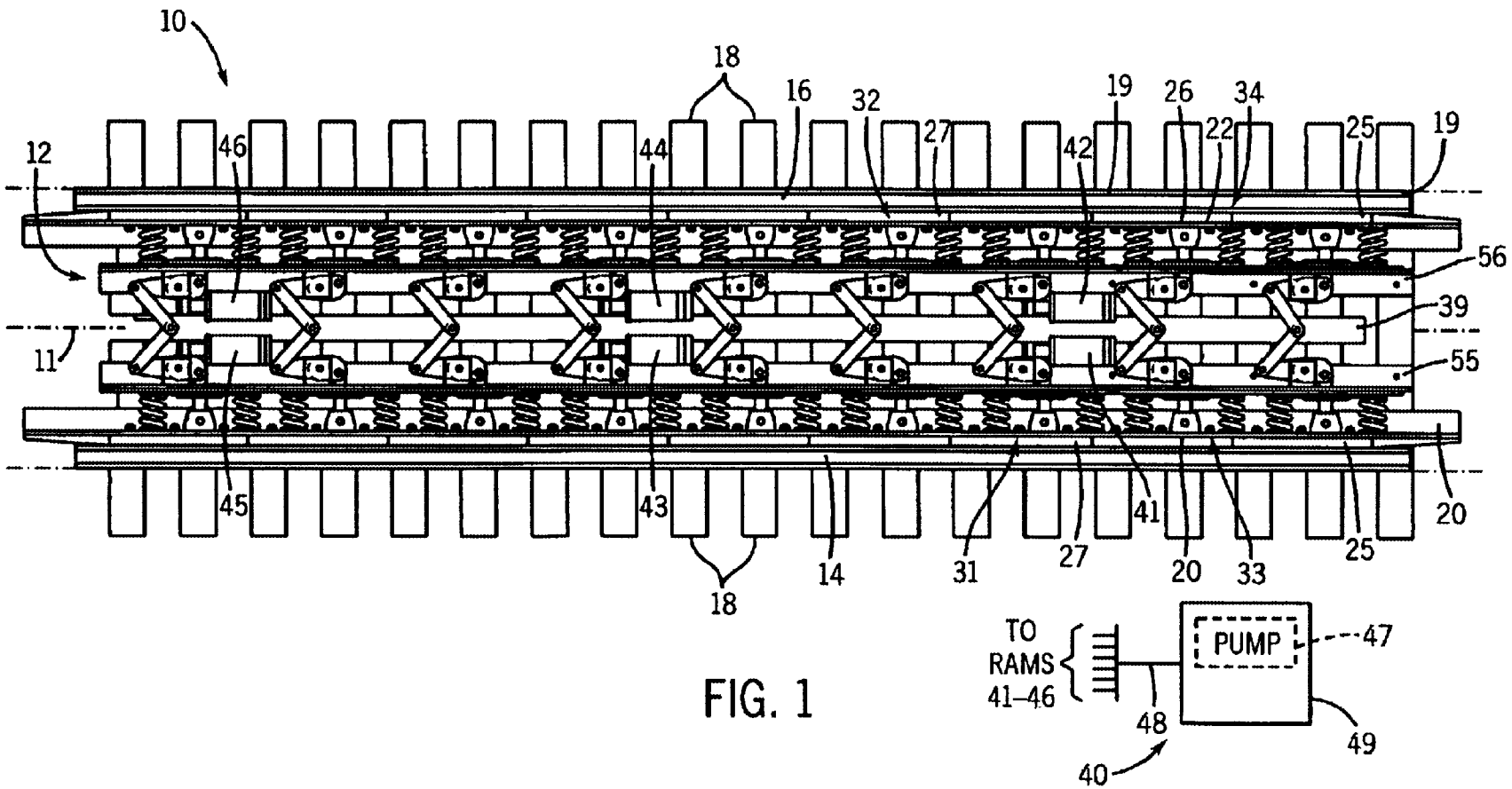
FIG. 1 is a top plan view of one embodiment of a railway car retarder provided by the present invention.

Referring to FIG. 1 of the drawings, there is shown a section of railway track 10 incorporating a railway car retarder 12 of the present invention. The railway track 10 includes a left running rail 14 and a right running rail 16 which are supported on ties 18 in the conventional manner. In one preferred embodiment, the retarder 12 is a skate retarder which is used in primarily for stopping the first railway car into a classification track and allowing other railway cars to couple to it while eliminating the possibility of the railway car running out of the retarder 12.

Figure 2:
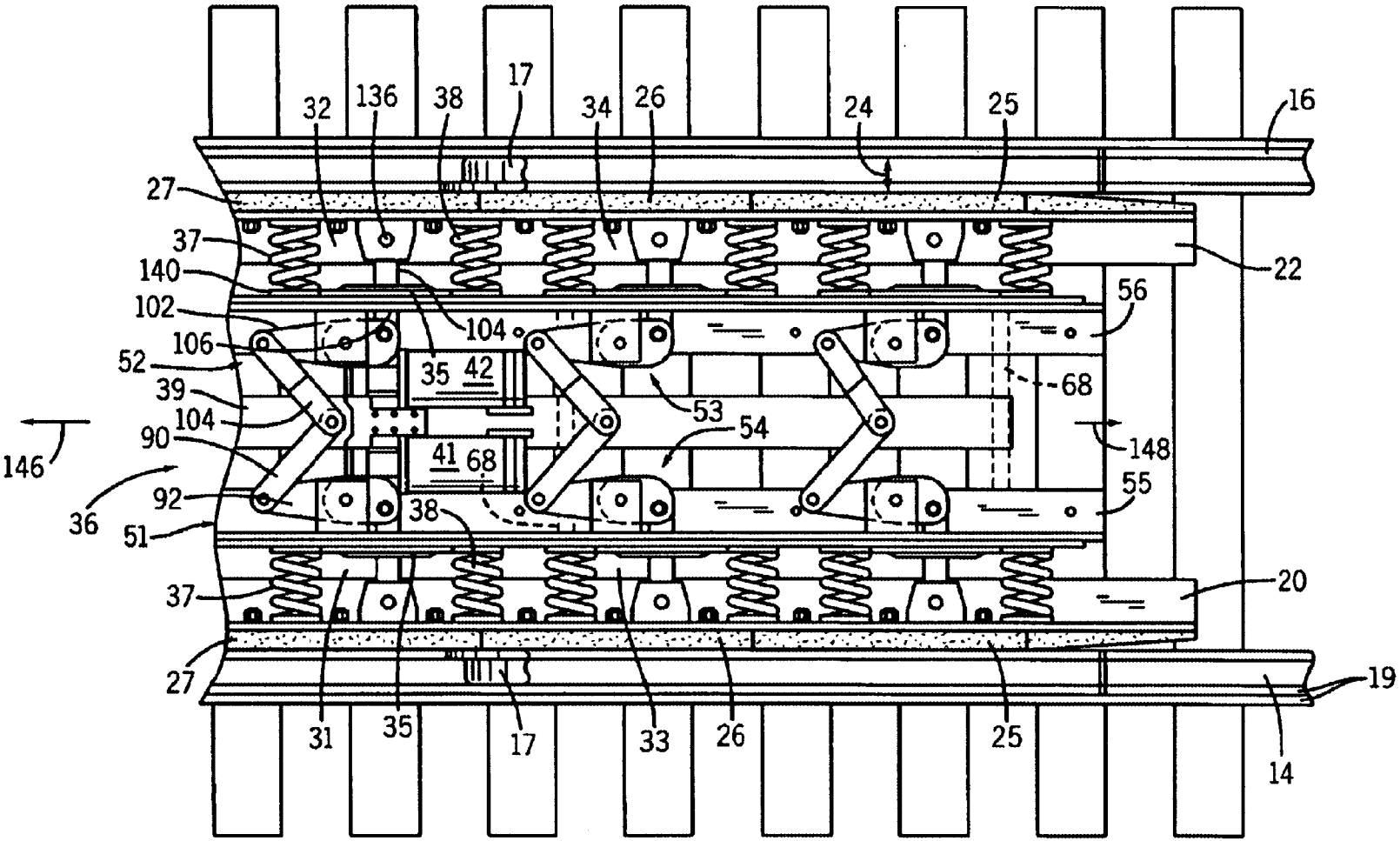
FIG. 2 is an enlarged view of a portion of the railway car retarder of FIG. 1.

The retarder 12 includes a pair of shoe beams 20 and 22 which extend parallel to the running rails 14 and 16, near the insides of the running rails 14 and 16, respectively. The shoe beams 20 and 22 carry replaceable shoes, such as shoes 25, 26 and 27, preferably of steel. The shoes are engaged by the wheels of a railway car moving through the gap 28 between the running rails 14 and 16 and the shoe beams 20 and 22. The shoes 25 at least at the input of the retarder 12 preferably are tapered inwardly at an angle toward the center of the track 10 in order to allow the wheels, such as wheel 17, of a railway car to enter and be trapped within the retarder 12 as shown in FIG. 2. Wheel 17 is shown trapped between running rail 12 and a shoe 27 carried on shoe beam 20.

Referring also to FIG. 2 the retarder 12 further includes a plurality of spring packs, such as spring packs 31–34, and an operating mechanism 36. In one embodiment, the retarder 12 includes eighteen spring packs. Each of the spring packs 31–34 includes a pair of springs 37 and 38. The springs 37 and 38 produce an outwardly directed force on the shoe beams 20 and 22 to move the shoe beams 20 and 22 toward their related running rails 14 and 16, for applying a frictional force to the wheels of a railway car moving into or located within the retarder 12.

In one embodiment, the retarder 12 is twenty-eight feet long and provides a frictional force over a twenty-six feet section. Typical prior art skate retarders provide frictional force over only about a sixteen foot section. The longer run for the retarder 12 provided by the present invention provides a more even distribution of required force over a greater distance to process all railway cars from the lightest weight, slowest moving railway car to the heaviest, fastest moving railway car.

In one embodiment, the operating mechanism 36 includes an operating bar 39 located near the centerline 11 of the track 10 and a hydraulic system 40 for displacing the operating bar axially along the centerline 11 of the track 10. In one embodiment, the hydraulic system 40 includes six rams 41–46. The hydraulic rams 41–46 are operated by hydraulic fluid supplied by a pump 47 and hydraulic lines 48 which extend to all of the rams, the connections not being shown for clarity of the drawing. The pump 47 can be contained within a pump housing 49 that is located along side of the track 10. While in one embodiment, a hydraulic system is used for driving the operating bar, other driving mechanisms, including pneumatic systems, can be used.

The operating mechanism 36 further includes a plurality of lever systems, such as lever systems 51–54 which couple the operating bar 39 to the spring packs 31–34. In one embodiment, the operating mechanism includes eighteen lever systems each associated with one of the spring packs. The retarder 12 includes left and right frame rails 55 and 56 which support the lever systems.

Figure 5:
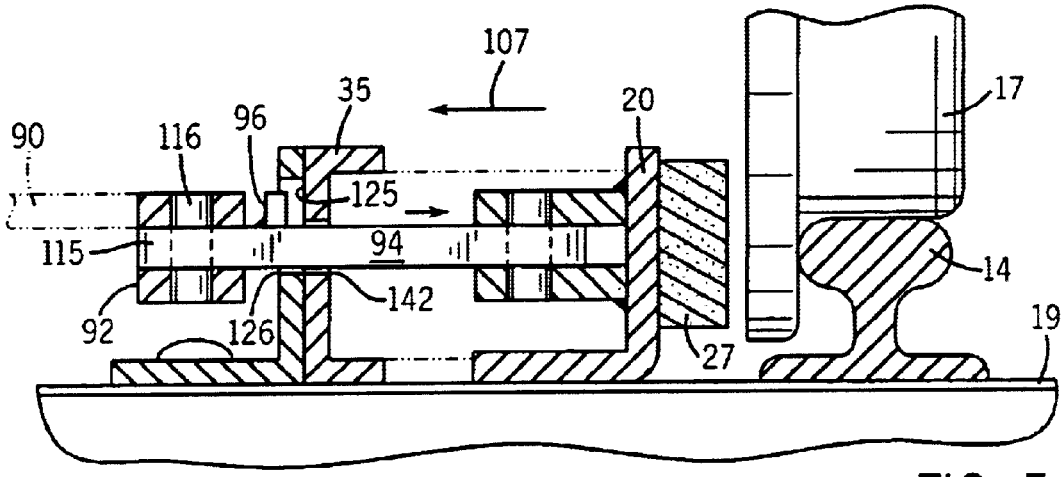
FIG. 5 is a view of a portion of FIG. 4 and showing the shoe beam retracted.

The operating mechanism 36 operates the retarder 12 between a retarding condition in which the shoe beams are located in a home position, shown in FIG. 2, for example, and a releasing condition in which the shoe beams are located in a release position shown in FIG. 5, for example. In the home position, the springs 37 and 38 provide a force for stopping a railway car directed into the retarder 12 and retaining the railway car in the retarder. In the release position, the spring force is released, allowing the railway car to be moved freely through the retarder 12. In accordance with another aspect of the invention, the retarder 12 is operable also between the retarding condition and a service condition in which the shoe beams are located in a maintenance position, shown in FIG. 9, as will be described.

The retarder 12 is supported on a rigid tie plate 19 which in turn is supported on and secured to the ties 18 which are spaced along the length of the retarder. Preferably, the left and right edges of the tie plate 19. extend beneath the running rails 14 and 16 at opposite sides of the track 10 is shown in FIG. 1. The tie plate 19 preferably is of steel to allow support components of the retarder 12 to be secured to the tie plate 19 by welding, or in any other suitable way. For example, the frame rails 55 and 56 preferably are welded, or otherwise secured, to the tie plate 19.

Figure 4:
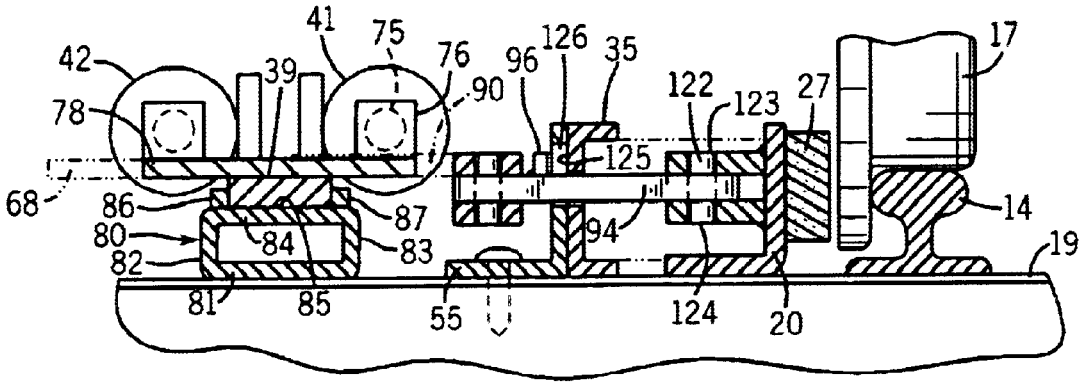
FIG. 4 is a section view taken along the line 4—4 of FIG. 3, and showing a wheel of a railway car located between the running rail and a shoe.

In one embodiment, the shoe beams 20 and 22 are L-shaped members including a horizontally extending foot, shown in FIG. 4, for example, which is supported on the tie plate 19, allowing the shoe beams to slide laterally inwardly and outwardly along the upper surface of the tie plate 19. This allows the shoe beams 20 and 22 to be drawn inwardly and moved outwardly relative to the centerline 11 of the track 10.

Figure 3:
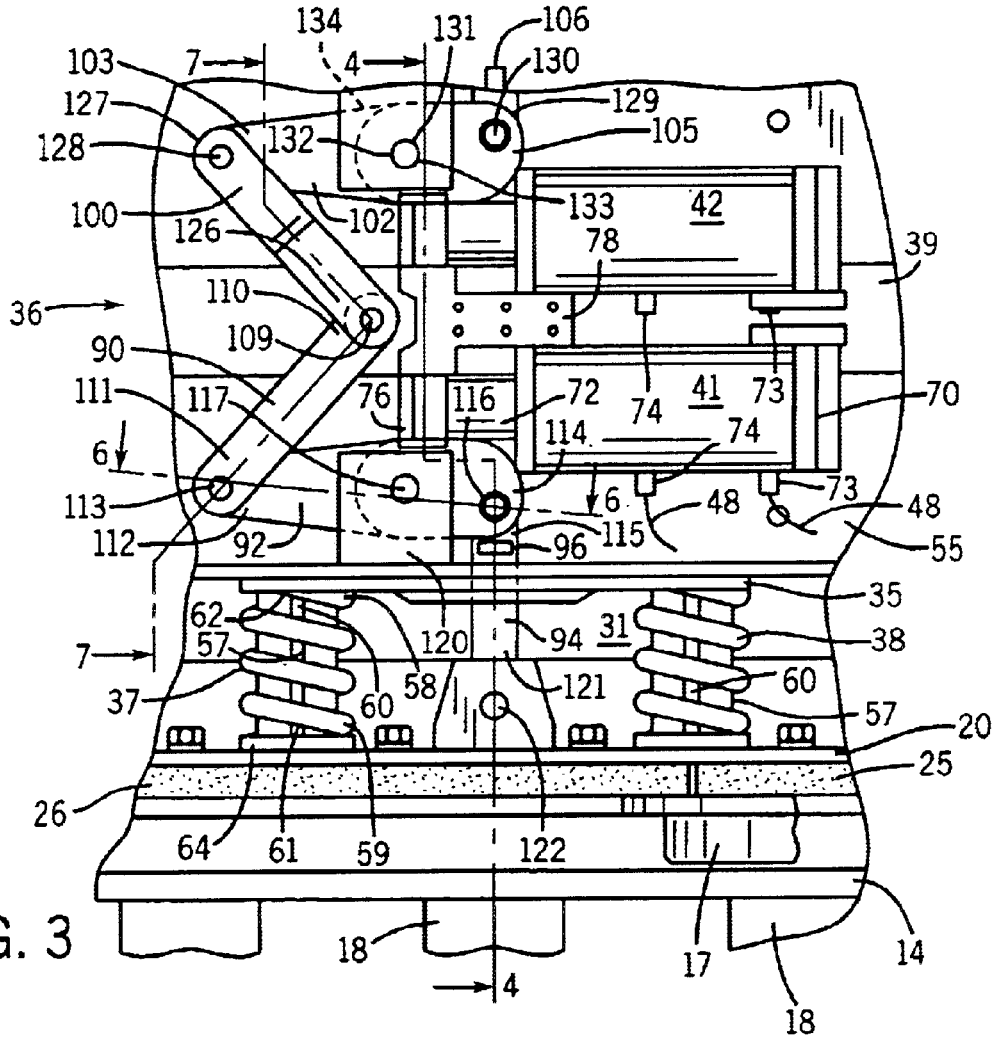
FIG. 3 is an enlarged view showing one of the spring packs and the associated operating mechanism of the portion of the retarder of FIG. 2.

Considering the retarder 12 in more detail, referring to FIGS. 1, 2 and 3, each spring pack, such as spring pack 31, further includes a spring pack plate 35. The springs 37 and 38 of spring pack 31 are high strength springs, preferably made of steel. The springs 37 and 38 are interposed between the shoe beam 20 and the spring pack plate 35. Spring 37 has an inner end 58 contacting the spring pack plate 35 and an outer end 59 contacting the shoe beam 20. A rod 60 (FIG. 3) extends through the spring 37 and has one end 61 secured to an alignment plate 64 which is mounted to the shoe beam 20. The other end 62 of the rod 60 passes through and is supported within aligned openings in the spring back plate 35 and the frame rail 55. In one embodiment, the axial length of the springs 37 and 38 is about nine and one-half inches and the springs are precompressed to about eight inches.

The spring pack plates 35 can be L-shaped members including a horizontally extending foot, shown in FIG. 3, for example, which is supported on the tie plate 19, allowing the spring pack plates 35 to slide laterally inwardly and outwardly along the upper surface of the tie plate 19. In one embodiment, a smaller spring, such as spring 57 (FIG. 3), is located within and concentric with the outer spring 37. The concentric inner and outer springs increase the compression force on the shoe beam 20 without requiring an increase in the outer diameter of the spring 37. Spring packs 32–34 are similar to spring pack 31 in structure and function, and accordingly, components of spring packs 32–34 have been given the same reference numbers as corresponding elements of spring pack 31.

The rams 41–46 are similar to one another and are arranged in pairs. Each ram, such as ram 41, is a hollow core ram having a housing 70 with a rod 72 projecting from one end 71of the housing. Rams 41 and 42 can be mounted to respective frame rails 55 and 56. The rams 41–46 are adapted to be driven bidirectionally. The ram 41 has a rod extend port 73 for receiving hydraulic fluid to cause the rod 72 to be extended (and for acting as an outlet port allowing hydraulic fluid to be removed from the housing during retraction), and a rod retract port 74 for receiving hydraulic fluid to cause the rod to be retracted (and for acting as an outlet port allowing hydraulic fluid to be removed from the housing during extension). The rod end 75 of the ram 41 can include a clovis 76 or other connecting structure to facilitate connection of the rod end 75 to a mounting plate 78. The mounting plate 78 is secured to the operating bar 39, by rivets, by welding or any other suitable way.

The bidirectional operation allows the rams 41–46 to provide two distinct functions. Operating the rams in one direction from the home position, causes the shoe beams 20 and 22 to be drawn inwardly. Operating the rams in the opposite direction from the home position causes the shoe beams 20 and 22 and the spring packs 31–34 to be forced outwardly from "gauge", allowing insertion of shims to compensate for shoe wear. All six rams 41–46 are operated substantially simultaneously in response to the application of hydraulic fluid to the rams. Also, the six rams are coupled to a common operating bar 39 for repositioning both shoe beams 20 and 22 substantially simultaneously, inwardly or outwardly relative to the center of the track 10.

In one embodiment, each of the rams 41–46 has an eight inch stroke. At the home position, the rod 72 is extended three inches. The rod 72 can be driven up to five inches from the home position to the release position. The rod 72 can be driven up to three inches from the home position to the maintenance position.

When the operating bar 39 is driven by the rams 41–46, the operating bar 39 is guided by a plurality of stabilizers, such as stabilizer 80 shown in FIG. 4, to guarantee equal distribution of force to all sets of levers and cranks of the retarder 12. Each stabilizer, such as stabilizer 80, is a box-like structure having a flat base portion 81, vertical sidewalls 82 and 83 and an upper member 84 providing a flat support surface 85 for the operating bar 39. The stabilizers are located along the centerline 11 of the track 10 and preferably are welded to the tie plate 19. Spacers 86 and 87 secured to the upper member 84 at opposite sides of surface 85, center the operating bar on the stabilizer 80. A spreader bar 68,. represented by the dashed line in FIG. 5, extends over the spacers, boxing in the operating bar 39, preventing the operating bar from lifting up. The spreader bar 68 is secured to the frame rails 55 and 56 at opposite ends thereof and further functions to maintain a preset spacing between the frame rails.

Figure 6:
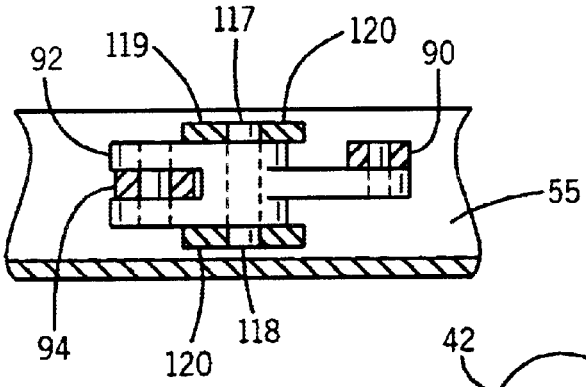
FIG. 6 is a detailed cross-section view taken along the line 6—6 in FIG. 3.
Figure 7:
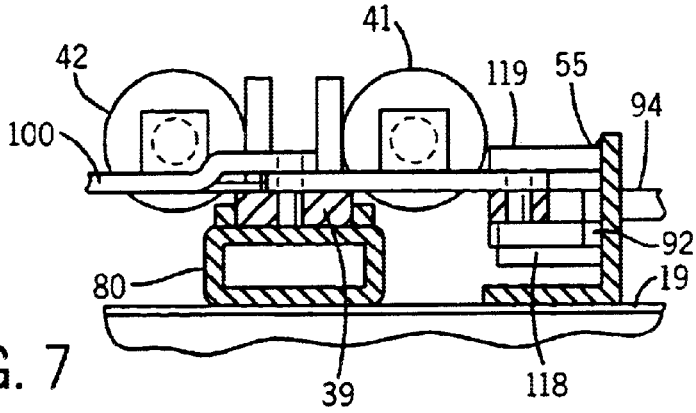
FIG. 7 is a detailed cross-section view taken along the line 7—7 in FIG. 3.

The operating bar 39 is coupled to spring packs 31–34 by respective lever systems 51–54. Referring also to FIGS. 6 and 7, each lever system, such as lever system 51 for coupling the operating bar 39 to spring pack 31, includes a lever 90, a crank 92 and a draw bar 94. The lever 90 has one end 110 pivotally connected to the operating bar 39 by a pin and bushing 109 and its opposite end 111 pivotally connected to one end 112 of crank 92 by a pin and bushing 113. The opposite end 114 of crank 92 is pivotally connected to one end 115 of the draw bar 94 by a pin and bushing 116. The crank 92 is pivotally mounted to the frame rail 55, supported between parallel flange portions 120 and held in place by a pin and bushing 117 which extend through aligned openings 116 and 119 in the crank 92 and in the flange portion 120 of the frame rail 55. The pin 117 defines the pivot axis for the crank 92, the pivot axis being located between the ends 112 and 114 of the crank 92, offset from the center of the crank 92 toward end 114. The other end 121 of the draw bar 94 is connected to the shoe beam 20 by a pin and bushing 122 which extend through aligned openings 123 and 124 in the shoe beam 20 and the draw bar 92. The draw bar 94 includes a block 96 which is adapted to engage the inner surface 125 of the spring pack plate 35 of spring pack 31. The draw bar 94 is dimensioned to pass through an opening 126 in the frame rail 55, allowing the block 96 to engage the inner surface 125 of the spring pack plate 35 of spring pack 31 when the retarder is operated to the service condition as will be shown. The draw bar 94 extends through an opening 142 in the spring pack plate 35.

Similarly, the operating bar 39 is coupled to spring pack 32 by lever system 52 which includes a lever 100, a crank 102 and a draw bar 104. Lever 100 has one end 126 pivotally connected to the operating bar 39 along with lever 90 by pin 109 and its opposite end 127 pivotally connected to one end 103 of the crank 102 by a pin and bushing 128. The opposite end 105 of the crank 102 is pivotally connected to one end 129 of the draw bar 104 by a pin and bushing 130. The crank 102 is pivotally mounted to the frame rail 56 by flange portions 134, in the manner or crank 92, and held in place by a pin and bushing 131 which extend through aligned openings 132 and 133 in the crank 102 and the flange portion 134 of the frame rail 56. The pin 131 defines the pivot axis for crank 102, which is offset from the center of the crank toward end 105. The other end 135 of the draw bar 104 is connected to the shoe beam 22 by a pin and bushing 136 in the manner of shoe beam 20 and the draw bar 94 (FIG. 3). The draw bar 104 includes a block 106 which is adapted to engage the inner surface 140 of the spring pack plate 35 of spring pack 32. The draw bar 104 is dimensioned to pass through an opening (not shown) in the frame rail 56 in the manner of draw bar 92 and frame rail 55, allowing the block 106 to engage the inner surface 140 of the spring plate 35 of spring pack 32 when the retarder is operated to the service condition.

Figure 9:
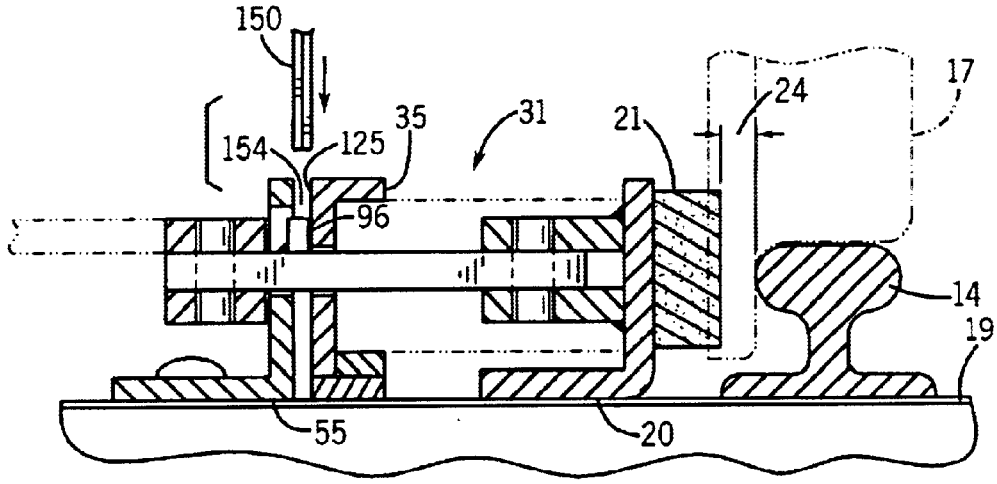
FIG. 9 is a fragmentary view of the railway car retarder of FIG. 2 with the lever system shown operated to the maintenance position to installation of a shim.
Figure 10:
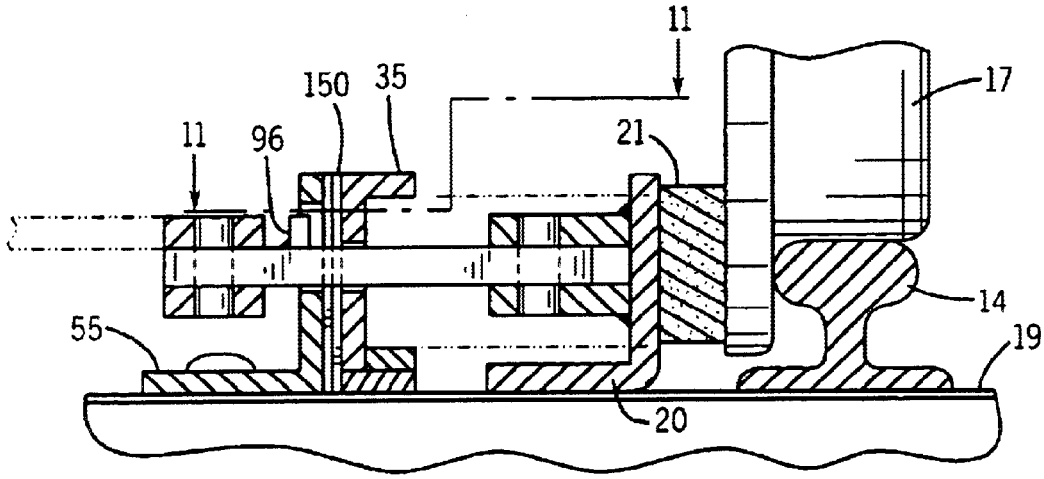
FIG. 10 is a view similar to that of FIG. 9 with shims installed.

The operating mechanism 36 allows the spring packs 31–34 to be pushed outwardly away from the frame rails 55 and 56, providing a gap 154 therebetween, allowing shims 150 to be inserted between the spring packs 31–34 and the frame rails 55 and 56 as shown in FIG. 9. When returned to the home position (FIG. 10), the shoes 25, 26 and 27 are repositioned outwardly a distance corresponding to the thickness of the shims 150, compensating for wear of the shoes.

The lever systems 51–54 provide a mechanical advantage. Because of the mechanical advantage, as the levers are rotated, the angle between the levers and the axis of the operating bar 39 increases towards 900, so that the force required to compress the springs 37 and 38, and maintain the springs 37 and 38 compressed, is decreased.

Referring to FIGS. 1, 2 and 4, the operation of the railway car retarder 12 is now described. Initially, the railway car retarder 12 is in the home position. Accordingly, a railway car directed into the retarder 12 has its wheels pass between the running rails 14 and 16 and the shoe beams 20 and 22.

Referring also to FIG. 5, when a railway car positioned within the retarder 12 is to be moved out of the retarder, the rams 41–46 are actuated to extend the rods 72. This moves the operating bar 39 in the direction of the arrow 146 (to the left in FIG. 2). When the operating bar 39 is moved in this direction, the levers 90 and 100 pivot about pivot 109, rotating the crank 92 counterclockwise and crank 102 clockwise. As the cranks 92 and 102 are rotated, draw bars 94 and 104 are pulled inwardly (in the direction of arrow 107 for draw bar 94), drawing the shoe beams 20 and 22 inwardly toward the center of the track 10, against the force of the springs 37 and 38, compressing the springs.

All of the springs 37 and 38 are compressed inwardly at the same time, allowing force to release from the retarder 12, permitting railway cars to be freely pulled from the classification track by eliminating applied friction to the wheels of the railway car. Consequently, with the spring force removed, the railway car is released, allowing the railway car to be moved freely through the retarder 12 and out of the classification yard. While the foregoing description of operation refers only to spring packs 31 and 32, the springs 37 and 38 of all of the spring packs are compressed substantially simultaneously and the shoe beams 20 and 22 are drawn inwardly along the longitudinal extent of the retarder 12.

When all of the railway cars of the string of railway cars have been moved through the retarder 12, the rams 41–46 are driven in the reverse direction to retract the rod 72 to the home position, moving the operating bar 39 to the right in FIG. 2. This causes the shoe beams 20 and 22 to be moved back to the home position.

Figure 8:
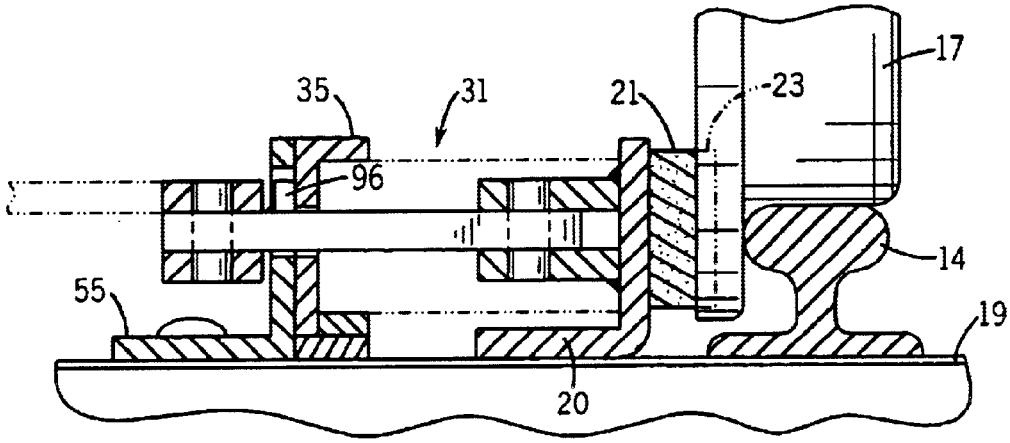
FIG. 8 is a fragmentary view of the railway car retarder of FIG. 2, showing a worn shoe.

In accordance with a further aspect of the invention, the retarder 12 affords rapid adjustment for compensating for wear of the shoes 25, 26 and 27. The need or desirability for wear adjustment can be determined by measuring the distance between the outer surface of one or more of the shoes 25, 26 and 27, with the outer surface of the aligned shoe or shoes located at the opposite side of the track to determine the spacing between the aligned shoe pairs 25, 26 and 27. FIG. 8, illustrates a shoe 21 engaging a railway car wheel 17 wherein the shoe is worn as indicated at 23.

Referring to FIGS. 2, 3 and 8, to adjust for wear, the retarder 12 is operated to the maintenance position. The rams 41–46 are operated to retract the rods 72 to move the operating bar 39 in the direction of the arrow 148 (to the right in FIG. 2). As the operating bar 39 is moved in the direction, lever 90 is rotated clockwise and lever 100 is rotated counterclockwise, causing crank 92 to be rotated clockwise and crank 102 to be rotated counterclockwise. As the cranks 92 and 102 of lever systems 51 and 52 are rotated, the draw bars 94 and 104 are extended, i.e., pushed outwardly away from the center of the track 10, moving blocks 96 and 106 into engagement with the spring pack plates 35. With continued rotation of the cranks 92 and 102, the draw bars 94 and 104 push the spring packs 31 and 32 outwardly, away from the center of the track 10 (while spring packs 33 and 34 are being pushed outward by respective lever systems 53 and 54) as shown in FIG. 9 where the wheel 17 is shown in phantom.

Figure 11:
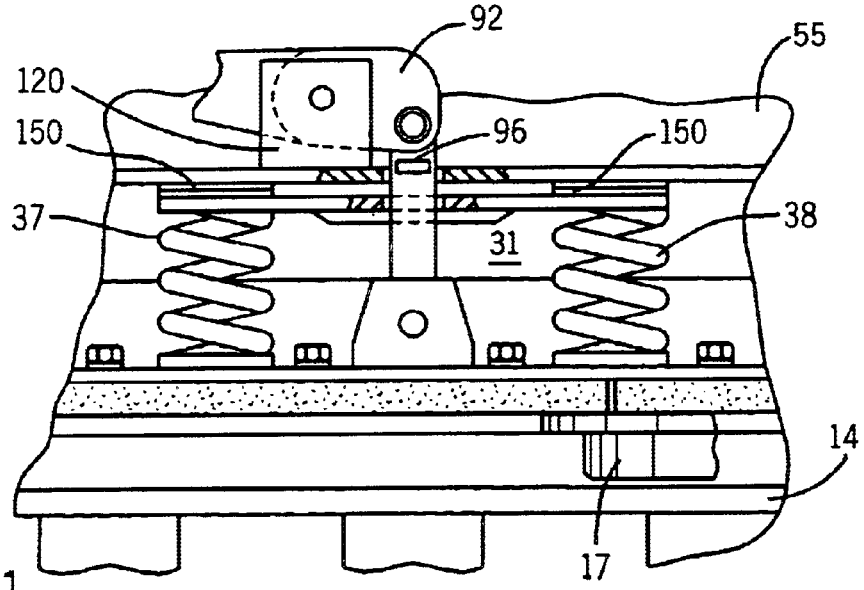
FIG. 11 is a view along line 11—11 in FIG. 10.

When the spring packs 31–34 are moved outwardly, a gap 154 is opened between the inner surface 125 of the spring pack plate 35 of spring pack 31 and the outer surface of the frame rail 55 and between the inner surface of spring pack plate 35 of spring pack 32 and the outer surface of the frame rail 56. This allows shims 150 to be installed in each of the gaps 154 between the spring packs 31 and 32 and frame rails 55 and 56, as shown in FIG. 9. In one embodiment, the shims are of a steel plate, generally rectangular in shape and sized to extend over a substantial portion of the overlying surfaces of the spring pack plates and frame rails, or can be two separate shims as shown in FIG. 11. However, the shims 150 can have other sizes and shapes, and can be of other suitable materials. The shims preferably are held in place by friction, with the lower edges of the shims resting on or located just above the tie plate 19. However, the shims can be secured mechanically. Shims are inserted on both sides of the track 10, for each spring pack, along the length of the retarder 12. While the foregoing description of operation refers only to spring packs 31 and 32, all of the spring packs are moved substantially simultaneously outward relative to the frame rails 55 and 56 producing a gap which extends the length of the retarder 12.

In the maintenance mode, the force is applied directly to the spring pack plates 35 rather than to the openings through the draw bars 94 and 104 and the flange portions of the shoe beams.

The adjustment of the gap 24 is carried out without loosening of bolts of the like, to allow readjustment of components followed by realignment of the components and tightening of bolts that had been loosened. In the retarder 12 provided by the invention, wear adjustment requires merely activating the rams 41–46 to retract the rod, inserting the shims, and then reversing the drive applied to the rams 41–46 to extend the rod, allowing the spring packs to return to the adjusted position.

After the shims 150 have been installed for each spring pack, the rams 41–46 are driven in reverse, to move the spring packs toward the home position. Because of the presence of the shims, the travel is limited so that the spring packs do not reach the original home position, but are stopped in an adjusted position, shown in FIG. 10. When in the adjusted position, the shoes are projected or positioned outwardly toward the running rails 14 and 16, decreasing the gap 24, thereby compensating for wear.

While preferred embodiments have been illustrated and described, it should be understood that changes and modifications can be made thereto without departing from the invention in its broadest aspects. For, example, while the retarder provided by the invention is described with reference to an application as a skate retarder, with modifications which are apparent to one skilled in the art, a retarder including an operating mechanism having a common drive member, such as operating bar 39, and lever systems similar to those described herein, can have other applications in a railway classification yard. Various features of the invention are defined in the following claims.

What is claimed is:

1. A releasable retarder for resisting movement of railway cars moving along first and second running rails of a section of railway track, said releasable retarder comprising:

first and second shoe beams supported adjacent to said running rails;

a plurality of pairs of shoes carried by said shoe beams in a parallel, spaced relation with the first and second running rails;

a bias structure biasing the shoe beams toward the running rails, trapping wheels of a railway car entering the retarder between the running rails and the shoes carried by the shoe beams and applying a frictional force to the railway car wheels for slowing or stopping the railway car; and a bidirectional operating mechanism operable in a release mode for moving the shoe beams inwardly, away from the running rails, from a home position in which the shoes are positioned to engage the railway car wheels, to a release position in which the frictional force is released, allowing the railway car to move freely through the retarder, the operating mechanism operable in a service mode for moving the shoe beams outwardly, towards the running rails, from the home position to a service position, allowing insertion of at least one shimming element, whereby upon subsequent movement of the shoe beams by the operating mechanism toward the home position, the shimming element limits travel of the shoe beams such that the shoes are repositioned in an adjusted position outwardly of the home position, closer to the running rails, compensating for wear on the shoes.

2. The releasable retarder of claim 1, wherein the operating mechanism includes at least one drive mechanism and a common operating member which couples the drive mechanism to the bias structure as the operating mechanism moves the shoe beams from the home position towards the service position.

3. The releasable retarder of claim 2, wherein the drive mechanism includes a plurality of bidirectional rams coupled to said common operating member.

4. The releasable retarder of claim 3, wherein movement of the shoe beams by the operating mechanism relative to the running rails from the home position toward the service position, causes a gap to be provided between the bias structure and a support structure, allowing the insertion of said shimming element into the gap between the bias structure and the support structure for limiting travel of the shoe beams from the service position toward the home position.

5. The releasable retarder of claim 2, wherein the bias structure includes a plurality of spring packs each including at least one spring.

6. The releasable retarder of claim 5, wherein the drive mechanism causes the springs to be compressed, as the shoe beams are moved inwardly away from the running rails to the release position.

7. The releasable retarder of claim 5, wherein the spring packs are mounted to allow the springs of the spring packs to produce an outwardly directed force on the shoe beams.

8. The releasable retarder of claim 5, wherein said operating mechanism includes a plurality of lever systems, and the common operating member is coupled to the spring packs through the lever systems.

9. The releasable retarder of claim 2, wherein the operating member is supported near the centerline of the railway track section.

10. The releasable retarder of claim 1, wherein said shoes are removably mounted on said shoe beams.

11. A releasable retarder for resisting movement of a railway car moving along first and second running rails of a railway track, said releasable retarder comprising:

first and second shoe beams supported adjacent to said running rails;

a plurality of pairs of shoes carried by said shoe beams in a parallel, spaced relation with first and second running rails;

a plurality of springs biasing the shoe beams toward the running rails, trapping wheels of a railway car entering the retarder between the shoes carried by the shoe beams and the running rails and applying a frictional force to the railway car wheels for stopping the railway car and retaining the railway car in the retarder; and a bidirectional operating mechanism operable in a release mode for moving the shoe beams from a home position in which the shoes are positioned to engage the railway car wheels to a release position in which the frictional force is released, allowing the railway car to move freely through the retarder, said operating mechanism operable in a service mode for moving the shoe beams from the home position to a service position, allowing the insertion of shimming elements to compensate for wear on the shoes carried by the shoe beams, said operating mechanism including a plurality of rams and a common operating member which couples the rams to the springs, for causing the springs to be compressed, as the shoe beams are moved from the home position to the release position by the operating mechanism; and a lever system coupling the operating member to the shoe beams, the lever system providing a mechanical advantage for compressing the springs as the shoe beams are moved from the home position towards the release position.

12. The releasable retarder of claim 11, wherein said operating mechanism includes a plurality of lever systems, and the common operating member is coupled to the spring packs through the lever systems.

13. The releasable retarder of claim 12, wherein each of said lever systems include at least one lever and at least one coupling member coupled to said lever, said member adapted to engage one of said spring packs as said shoe beams are moved from said home position toward said service position.

14. The releasable retarder of claim 13, wherein said coupling member is coupled between said lever and one of said shoe rails and repositions said one spring pack as said one shoe rail is moved from said home position to said service position.

15. The releasable retarder of claim 11, wherein the rams are bidirectional devices.

16. The releasable retarder of claim 11 wherein said shoes are removably mounted on said shoe beams.

17. A releasable retarder for resisting movement of a railway car moving along first and second running rails of a railway track, said releasable retarder comprising:

first and second shoe beams supported adjacent to said running rails;

a plurality of pairs of shoes carried by said shoe beams in parallel, spaced relation with said first and second running rails;

a bias structure biasing the shoe beams toward the running rails, trapping wheels of the railway car entering the retarder between the running rails and the shoes carried by the shoe beams and applying a frictional force to the railway car wheels for stopping the railway car, retaining the railway car in the retarder; and a bidirectional operating mechanism operable in a release mode for moving the shoe beams inwardly from a home position in which the shoes are positioned to engage the railway car wheels to a release position in which the bias force is released, allowing the railway car to move freely through the retarder, and at least one shimming element;

the operating mechanism operable in a service mode for moving the shoe beams outwardly from the home position to a service position, allowing the insertion of the shimming element to compensate for wear on the shoes carried by the shoe beams.

* * * * *